US009472158B2

(12) United States Patent
Lin et al.

(10) Patent No.: US 9,472,158 B2
(45) Date of Patent: Oct. 18, 2016

(54) IMAGE DATA CORRECTION FOR VCOM ERROR

(71) Applicant: APPLE INC., Cupertino, CA (US)

(72) Inventors: Hung Sheng Lin, San Jose, CA (US); Chaohao Wang, Sunnyvale, CA (US); Szu-Hsien Lee, San Jose, CA (US); Weijun Yao, San Jose, CA (US); Yingxuan Li, Saratoga, CA (US); Wonjae Choi, Cupertion, CA (US)

(73) Assignee: APPLE INC., Cupertino, CA (US)

( * ) Notice: Subject to any disclaimer, the term of this patent is extended or adjusted under 35 U.S.C. 154(b) by 31 days.

(21) Appl. No.: 14/660,355

(22) Filed: Mar. 17, 2015

(65) Prior Publication Data

US 2016/0275899 A1 Sep. 22, 2016

(51) Int. Cl.
*G09G 3/36* (2006.01)

(52) U.S. Cl.
CPC .... *G09G 3/3696* (2013.01); *G09G 2310/0289* (2013.01); *G09G 2330/08* (2013.01)

(58) Field of Classification Search
CPC ..... G09G 3/3696; G09G 2330/08; G09G 2310/0289
See application file for complete search history.

(56) References Cited

U.S. PATENT DOCUMENTS

| | | | | |
|---|---|---|---|---|
| 7,859,504 | B2 | 12/2010 | Furihata et al. | |
| 8,228,287 | B2 * | 7/2012 | JaeHun | G09G 3/3655 345/103 |
| 8,373,729 | B2 | 2/2013 | Lee et al. | |
| 8,537,083 | B2 | 9/2013 | Nakatsuka | |
| 9,361,842 | B2 * | 6/2016 | Kim | G09G 3/3655 |
| 2002/0008686 | A1 | 1/2002 | Kumada et al. | |
| 2004/0164943 | A1 * | 8/2004 | Ogawa | G09G 3/3655 345/92 |
| 2012/0032932 | A1 | 2/2012 | Kojima | |
| 2014/0022153 | A1 * | 1/2014 | Lim | G09G 3/3611 345/92 |
| 2015/0187291 | A1 * | 7/2015 | Jang | G09G 3/3611 345/694 |
| 2015/0340002 | A1 * | 11/2015 | Hu | G09G 3/3696 345/89 |

* cited by examiner

*Primary Examiner* — Ryan A Lubit
(74) *Attorney, Agent, or Firm* — Fletcher Yoder PC

(57) ABSTRACT

Systems and methods are provided for adjusting and displaying image data to account for variable common voltage error across separate common electrode sub-plates. The image data may be adjusted based on a common mode common voltage error on a common voltage line coupled to more than one different common electrode sub-plate. Each common electrode sub-plate may carry a common voltage that varies depending on values of the image data programmed to pixels associated with that common electrode sub-plate.

19 Claims, 9 Drawing Sheets

IMAGE DATA CORRECTION FOR VCOM ERROR

CROSS REFERENCE TO RELATED APPLICATIONS

The present patent application is generally related to co-pending U.S. application Ser. No. 14/660,619 filed on Mar. 17, 2015, entitled "Content-Driven Slew Rate Control for Display Driver", by Hung Sheng Lin et al., which is incorporated into the present application by reference in its entirety for all purposes.

BACKGROUND

The present disclosure relates generally to displays for electronic devices. Specifically, the embodiments described herein generally relate to using pixel data voltages to account for errors in one or more common voltages within a display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays may be found in a variety of devices, such as computer monitors, televisions, instrument panels, mobile phones, and clocks. One type of electronic display, known as a liquid crystal display (LCD), displays images by modulating the amount of light allowed to pass through a liquid crystal layer within pixels of the LCD. In general, LCDs modulate the light passing through each pixel by varying a voltage difference between a pixel electrode and a common electrode. This creates an electric field that causes the liquid crystal layer to change alignment. The change in alignment of the liquid crystal layer causes more or less light to pass through the pixel. By changing the voltage difference supplied to each pixel, images are produced on the LCD.

In some LCDs, the value of the common voltage may vary across the LCD. For example, in some LCDs, the display panel may be composed of sub-plates associated with different respective groups of pixels. Variations in the amounts of electromagnetic cross-talk caused by differences in the sub-plates and/or electromagnetic noise from other electronic components near the LCD may cause the common voltage to settle to different final values across the LCD. A block mura artifact may arise when the common voltage is a different value for each sub-plate, thereby causing all of the pixels associated with each sub-plate to be different by some discernible brightness, and thereby producing visible blocks of brighter or darker pixels.

One method to reduce this effect may involve lowering the coupling capacitance between the signal lines for the common voltage and the source voltages. For example, specific placement and routing of the signals lines for the common voltage and the source voltages may be developed to reduce the capacitance between the signal lines. However, there may be limited areas for routing in an LCD, and, as mentioned above, the panel impedance may vary from sub-plate to sub-plate as well as across a given sub-plate. In other techniques, the display controllers and drivers may include a negative feedback system to correct the value of the common voltage. That is, a negative feedback system may be included for each sub-plate, which may sense the value of the common voltage at the sub-plate and send the corresponding data to the common voltage source. However, the negative feedback systems may increase the space requirements of the display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to liquid crystal displays (LCDs) for electronic devices. In liquid crystal displays, the amount of light emitted by a pixel is determined by the electric field created between two electrodes in the pixel. A common voltage may be provided to one of the electrodes in each pixel, while a controller in the display may determine the source voltage to apply at the second electrode for each pixel based on the image to be displayed. The present embodiments disclosed herein relate to correcting for differences in the value of the common voltage throughout the display to reduce or eliminate a block mura artifact that would otherwise appear due to the variations in the common voltage.

Specifically, the embodiments include systems, methods, and devices to determine the value of the common voltage received at each pixel based on the value of a common mode common voltage error that is common to more than one common electrode sub-plate and the change in the source voltages from one row to the next. Further, the source voltages may be adjusted for the pixels based on the value of the common voltage received at each pixel to create the desired electric fields and, accordingly, the desired pixel values. In some examples, this may be implemented by source driving circuitry within the display, thereby reducing the number of components added to the display as well as reducing the space requirements for the components. Further, the adjustment of data signals to account for common voltage errors may be used in display panels even despite relatively high impedance, since the systems and methods of this disclosure may not depend on reducing the panel impedance or specific placement and routing of signal lines, but rather may work in addition to or as an alternative to such measures.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
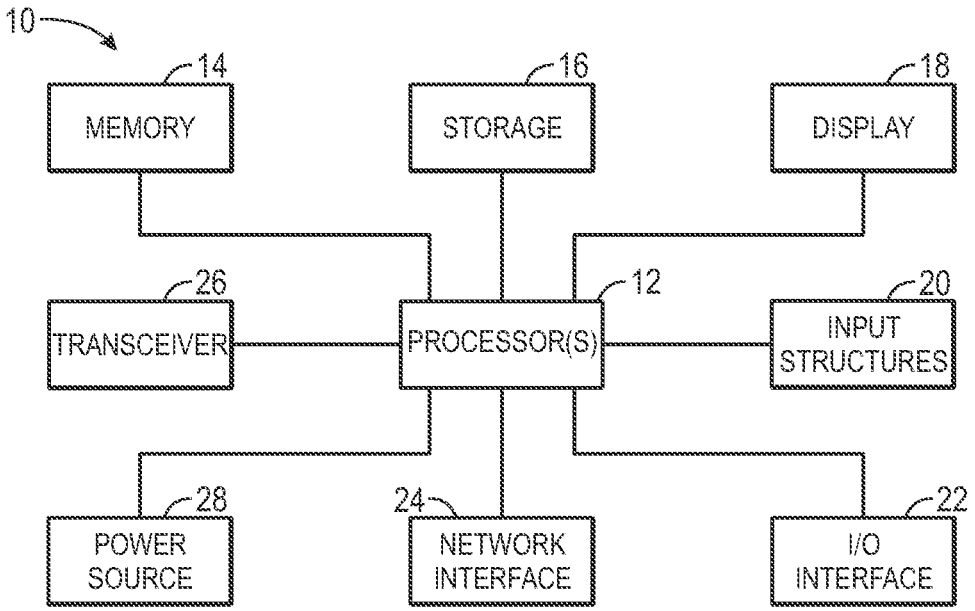
FIG. 1 is a schematic block diagram of an electronic device including a display, in accordance with an embodiment of the present approach.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Many types of electronic devices, such as computer monitors, wearable electronic devices, notebook computers, and the like include a display. In particular, electronic devices may include a liquid crystal display (LCD), which has a low electrical power consumption that is ideal for battery-powered devices. In an LCD, a backlight is disposed behind a group of pixels, each of which contains liquid crystal molecules that vary the amount of light passing through the pixel depending on an electric field imposed on the liquid crystal molecules. The electric field is created by a voltage difference between a common electrode that is shared by some number of pixels and a pixel electrode that is specific to each pixel. A common voltage is applied at the common electrode. Controllers and drivers of the LCD determine, based on the image to be displayed, a source voltage to apply at the pixel electrode of each of pixels. The difference between the voltages at the electrodes creates the electric field that causes the liquid crystal molecules disposed between the electrodes to turn. The position and alignment of the liquid crystal molecules determines the amount of light that passes through the pixel.

In some embodiments, the panel of the LCD may be divided into several sub-plates. However, variations in the resistance and/or capacitance of each of the sub-plates, as well as other variations such as different amounts of electromagnetic cross-talk caused by electromagnetic noise from other electronic components near the LCD, can cause the common voltage to settle to different final values across the LCD. A block mura artifact may arise when the common voltage is a different value for each sub-plate. In fact, the variations that may occur may even cause the value of the common voltage to vary across a single sub-plate. Noise accrued during signal transmission may also affect the value of the common voltage, particularly as the distance between a pixel and the common voltage source increases. Further, the changing electric fields in the pixels, due to the changing value of the source voltage from one row to the next, may introduce cross-talk that affects the value of the common voltage. Additionally, other components may also induce interference that affects the value of the common voltage. As mentioned above, the amount of light that passes through a pixel is dependent on the alignment of the liquid crystal molecules, which is dependent on the electric field created between the two electrodes. Therefore, if the common voltage deviates from an expected value, the magnitude of the electric field may be incorrect, and as such, an undesired amount of light may be emitted by the pixel.

To account for variations in the value of the common voltage, the source driving circuitry of an LCD, which controls the source voltages provided to the pixels, may perform a common voltage correction process. During the common voltage correction process, the source driving circuitry may sense the value of the common voltage at various locations throughout the LCD panel. The source driving circuitry may then determine the relationship between the values of the common voltage at different locations and the changes in the source voltage at each pixel from one frame to the next. Based on this relationship, the source driving circuitry then determines the actual value of the common voltage received at each pixel. The source driving circuitry may adjust the source voltages for each pixel to account for the expected variation in the value of the common voltage.

Turning to FIG. 1, an electronic device 10 according to an embodiment of the present disclosure may include, among other things, one or more processor(s) 12, memory 14, nonvolatile storage 16, a display 18, input structures 20, an input/output (I/O) interface 22, network interfaces 24, a transceiver 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
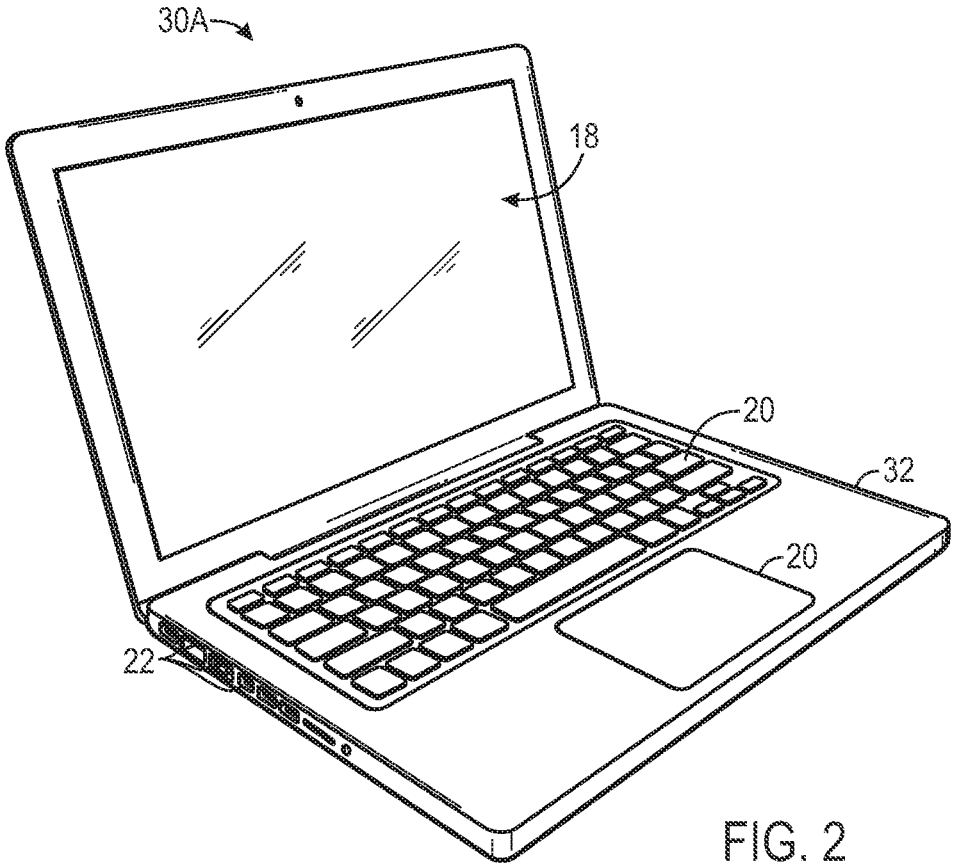
FIG. 2; is a perspective view of a notebook computer as the electronic device of FIG. 1, in accordance with an embodiment of the present approach.
Figure 3:
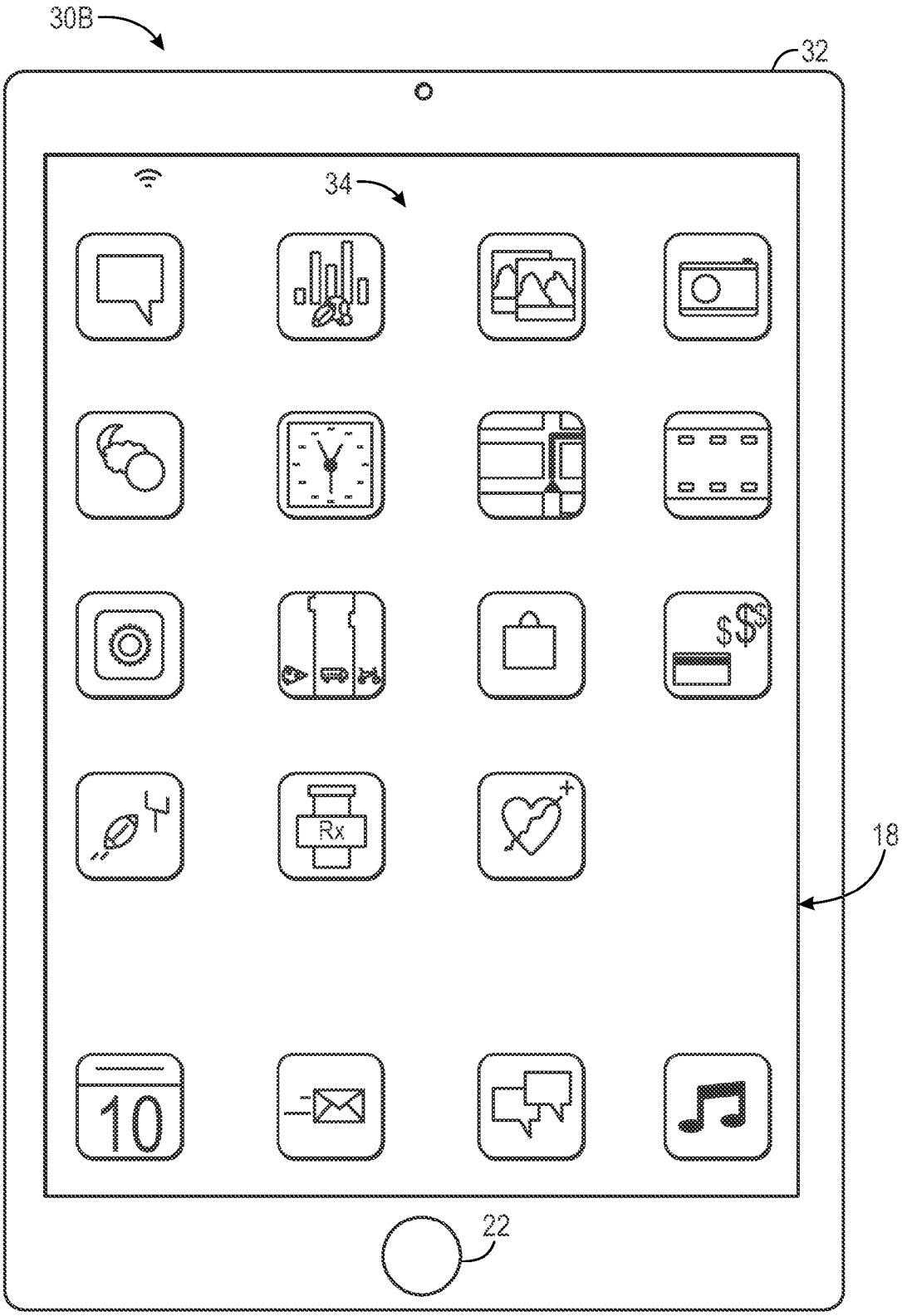
FIG. 3 is a front-view of a hand-held device as the electronic device of FIG. 1, in accordance with an embodiment of the present approach.
Figure 4:
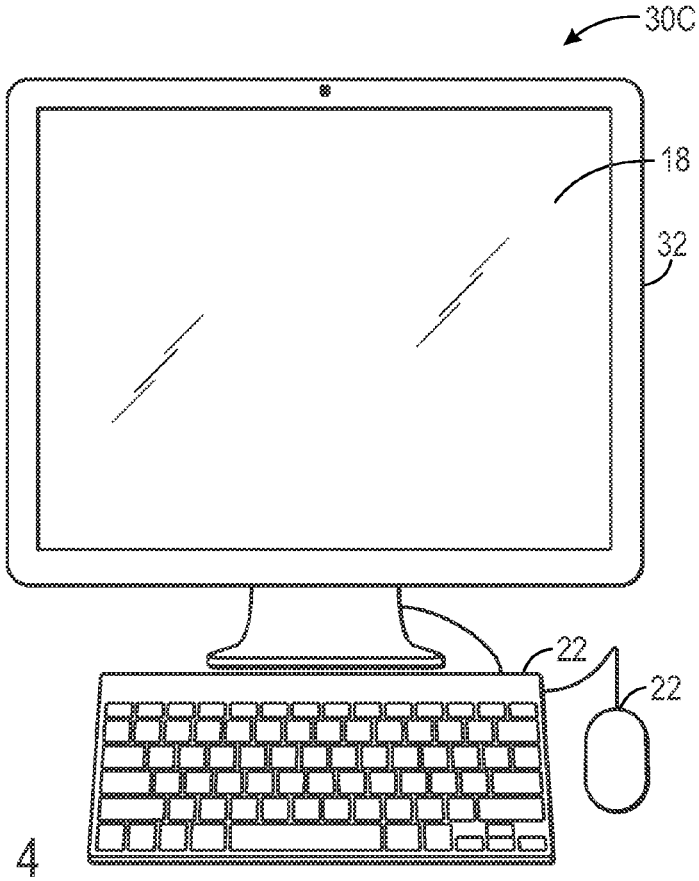
FIG. 4 is a front-view of a desktop computer as the electronic device of FIG. 1, in accordance with an embodiment of the present approach.
Figure 5:
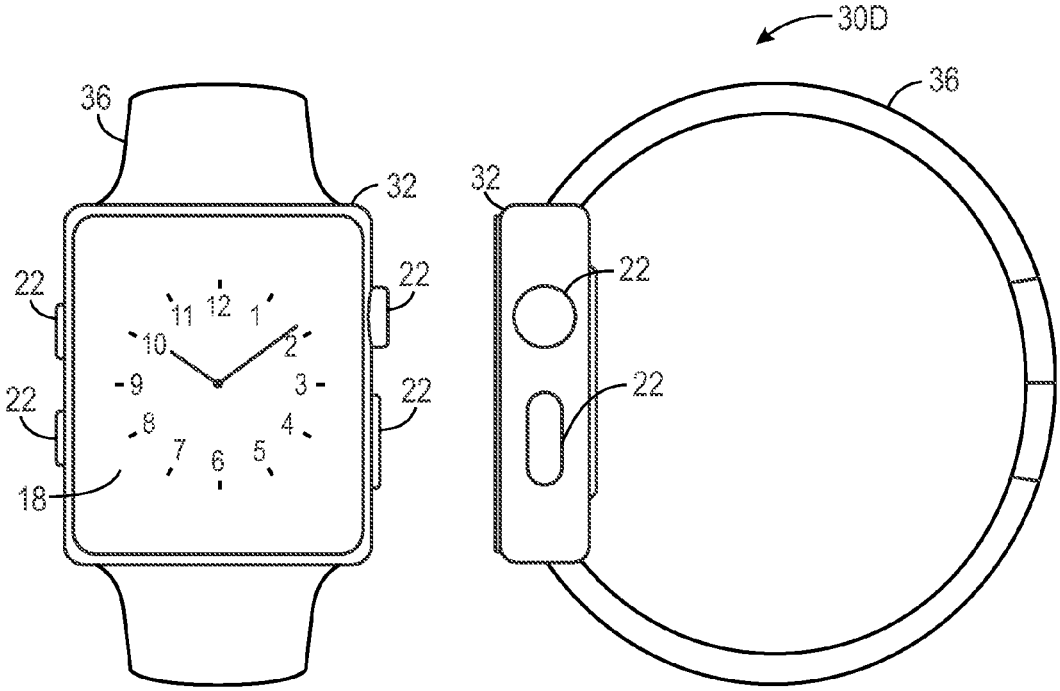
FIG. 5 is a front view and side view of a wearable electronic device as the electronic device of FIG. 1, in accordance with an embodiment of the present approach.

By way of example, the electronic device 10 may represent a block diagram of the notebook computer depicted in FIG. 2, the handheld device depicted in FIG. 3, the desktop computer depicted in FIG. 4, the wearable electronic device depicted in FIG. 5, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12 to enable the electronic device 10 to provide various functionalities.

The display 18 may be a liquid crystal display (LCD), which may allow users to view images generated on the electronic device 10. In some embodiments, the display 18 may include a touch screen, which may allow users to interact with a user interface of the electronic device 10. The display 18 may be a color display utilizing a plurality of color channels for generating color images. By way of example, the display 18 may utilize a red, green, and blue color channel.

In certain embodiments, the display 18 may include an arrangement of unit pixels defining rows and columns that form an image viewable region of the display 18. A source driver circuit may output this voltage data to the display 18 by way of source lines defining each column of the display 18. Each unit pixel may include a thin film transistor (TFT) configured to switch a pixel electrode. A liquid crystal capacitor may be formed between the pixel electrode and a common electrode, which may be coupled to a common voltage line ($V_{COM}$). When activated, the TFT may store image signals received via a respective data or source line as a charge in the pixel electrode. The image signals stored by the pixel electrode may be used to generate an electrical field between the respective pixel electrode and a common electrode. Such an electrical field may align liquid crystal molecules within a liquid crystal layer to modulate light transmission through the liquid crystal layer.

As will be described in further detail below, certain embodiments of the display 18 may include driver circuitry that adjusts data voltages supplied to the pixels to account for variations in common voltage due to noise, kickback, differing electrical characteristics, and so forth. The driver circuitry may sense the value of the common voltage supplied into different parts of the display 18, and may determine, based on the sensed value, a common mode error of differing voltage levels at various parts of the display 18. By also considering pixel values that were recently programmed into a previous row of pixels, and therefore likely to have affected the common voltage variation, the driver circuitry may determine a more specific common voltage error likely to be occurring in certain specific parts of the display (e.g., at different sub-plates of common electrodes). The driver circuitry may use this information to adjust the image signal of each pixel relative to the error to cause an appropriate electrical field to occur in each pixel. Such a technique may correct for variations in the common voltage across the display 18 due, among other things, to the impedance of the display panel. Adjusting the data voltages to account for errors in common voltage may avoid, in some cases, reducing the impedance of the display panel. As such, this disclosure may be particularly beneficial in relatively-high-impedance displays.

The input structures 20 of the electronic device 10 may enable a user to interact with the electronic device 10 (e.g., pressing a button to increase or decrease a volume level). The I/O interface 22 may enable electronic device 10 to interface with various other electronic devices, as may the network interfaces 24. The network interfaces 24 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $3^{rd}$ generation (3G) cellular network, $4^{th}$ generation (4G) cellular network, or long term evolution (LTE) cellular network. The network interface 24 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra Wideband (UWB), alternating current (AC) power lines, and so forth.

In certain embodiments, to allow the electronic device 10 to communicate over the aforementioned wireless networks (e.g., Wi-Fi, WiMAX, mobile WiMAX, 4G, LTE, and so forth), the electronic device 10 may include a transceiver 26. The transceiver 26 may include any circuitry the may be useful in both wirelessly receiving and wirelessly transmitting signals (e.g., data signals). Indeed, in some embodiments, tithe transceiver 26 may include a transmitter and a receiver combined into a single unit, or, in other embodiments, the transceiver 26 may include a transmitter separate from the receiver. For example, as noted above, the transceiver 26 may transmit and receive OFDM signals (e.g., OFDM data symbols) to support data communication in wireless applications such as, for example, PAN networks (e.g., Bluetooth), WLAN networks (e.g., 802.11x Wi-Fi), WAN networks (e.g., 3G, 4G, and LTE cellular networks), WiMAX networks, mobile WiMAX networks, ADSL and VDSL networks, DVB-T and DVB-H networks, UWB networks, and so forth. As further illustrated, the electronic device 10 may include a power source 28. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 20, and ports of an I/O interface 22. In one embodiment, the input structures 20 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a tablet-sized embodiment of the electronic device 10, which may be, for example, a model of an iPad® available from Apple Inc. of Cupertino, Calif.

The handheld device 30B may include an enclosure 32 to protect interior components from physical damage and to shield them from electromagnetic interference. The enclosure 32 may surround the display 18, which may display indicator icons 34. The indicator icons 34 may indicate, among other things, a cellular signal strength, Bluetooth connection, and/or battery life. The I/O interfaces 22 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 22, in combination with the display 18, may allow a user to control the handheld device 30B. For example, the input structure 22 shown in FIG. 3 may activate or deactivate the handheld device 30B, may navigate user interface to a home screen, a user-configurable application screen, and/or activate a voice-recognition feature of the handheld device 30B. In some embodiments, the input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

Turning to FIG. 4, a computer 30C may represent another embodiment of the electronic device 10 of FIG. 1. The computer 30C may be any computer, such as a desktop computer, a server, or a notebook computer, but may also be a standalone media player or video gaming machine. By way of example, the computer 30C may be an iMac®, a MacBook®, or other similar device by Apple Inc. It should be noted that the computer 30C may also represent a personal computer (PC) by another manufacturer. A similar enclosure 34 may be provided to protect and enclose internal components of the computer 30C such as a dual-layer display 18. In certain embodiments, a user of the computer 30C may interact with the computer 30C using various peripheral input devices or structures 22, such as a keyboard or mouse, which may connect to the computer 30C via a wired and/or wireless I/O interface 22.

Similarly, FIG. 5 depicts a wearable electronic device 30D representing another embodiment of the electronic device 10 of FIG. 1 that may be configured to operate using the techniques described herein. By way of example, the wearable electronic device 30D, which may include a wristband 36, may be an Apple Watch® by Apple, Inc. However, in other embodiments, the wearable electronic device 30D may include any wearable electronic device such as, for example, a wearable exercise monitoring device (e.g., pedometer, accelerometer, heart rate monitor), or other device by another manufacturer. The display 18 of the wearable electronic device 30D may include a touch sensor, which may allow users to interact with a user interface of the wearable electronic device 30D.

Figure 6:
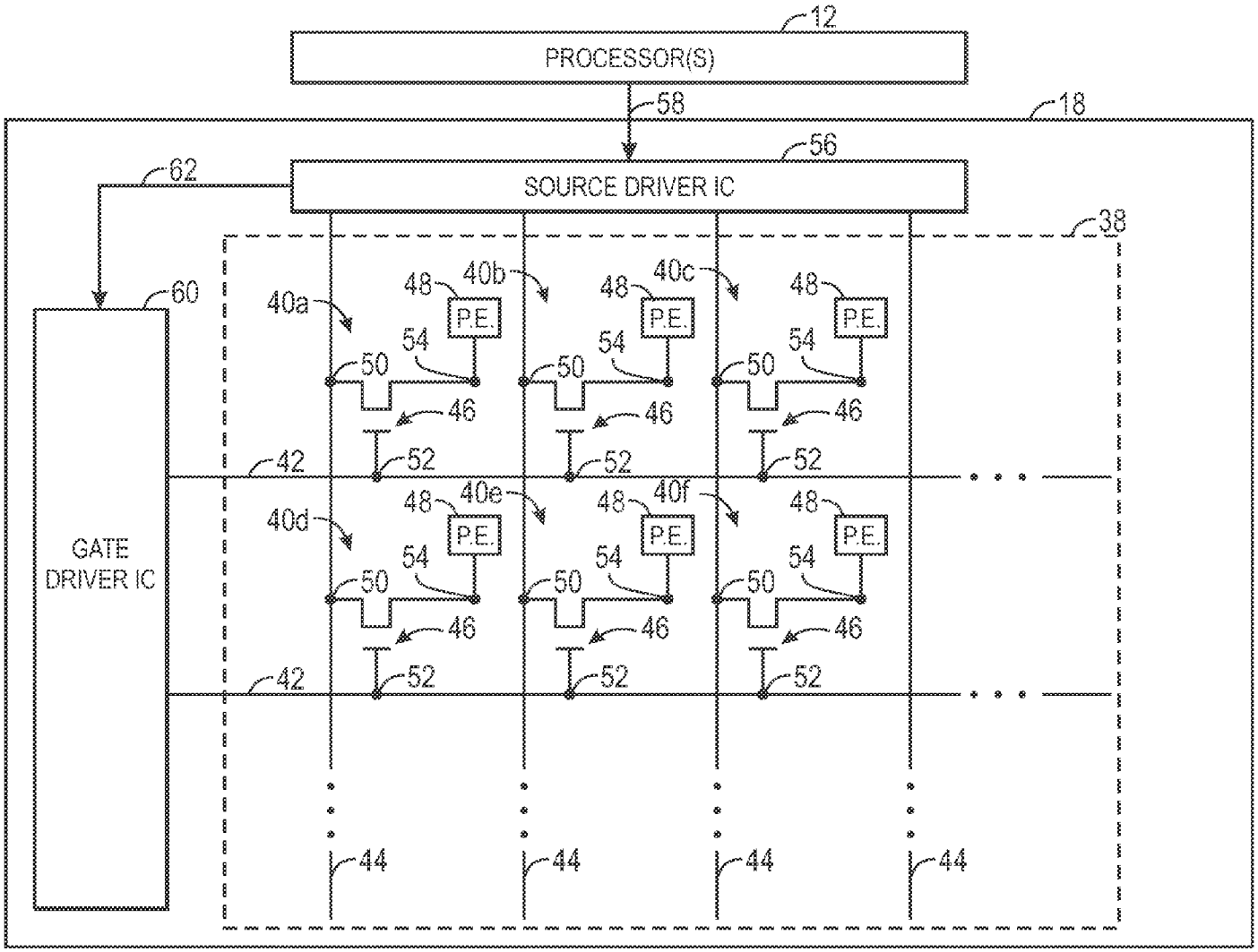
FIG. 6 is a circuit diagram illustrating the structure of pixels that may be provided in the display of FIG. 1, in accordance with an embodiment of the present approach.

Referring now to FIG. 6, a circuit diagram of the display 18 is illustrated, in accordance with an embodiment. As shown, the display 18 may include a display panel 38, such as a liquid crystal display (LCD) panel. The display panel 38 may include multiple unit pixels 40 disposed in a pixel array or matrix defining multiple rows and columns of unit pixels that collectively form an image viewable region of the display 18. In such an array, each unit pixel 40 may be defined by the intersection of rows and columns, represented here by the illustrated gate lines 42 (also referred to as "scanning lines") and source lines 44 (also referred to as "data lines"), respectively.

Although only six unit pixels, referred to individually by the reference numbers 40*a*-40*f*, respectively, are shown for purposes of simplicity, it should be understood that in an actual implementation, each source line 44 and gate line 42 may include hundreds, thousands, or millions of such unit pixels 40. By way of example, in a color display panel 38 having a display resolution of 1024×768, each source line 44, which may define a column of the pixel array, may include 768 unit pixels, while each gate line 42, which may define a row of the pixel array, may include 1024 groups of unit pixels, wherein each group includes a red, blue, and green pixel, thus totaling 3072 unit pixels per gate line 42. Although a display resolution of 1024×768 is mentioned by way of example above, the display panel 38 may include any suitable number of pixels. As may be appreciated, in the context of LCDs, the color of a particular unit pixel generally depends on a particular color filter that is disposed over a liquid crystal layer of the unit pixel. In the presently illustrated example, the group of unit pixels 40*a*-40*c* may represent a group of pixels having a red pixel (40*a*), a blue pixel (40*b*), and a green pixel (40*c*). The group of unit pixels 40*d*-40*f* may be arranged in a similar manner.

As shown in the present embodiment, each unit pixel 40*a*-40*f* includes a thin film transistor (TFT) 46 for switching a respective pixel electrode 48. In the depicted embodiment, the source 50 of each TFT 46 may be electrically connected to a source line 44. Similarly, the gate 52 of each TFT 46 may be electrically connected to a gate line 42. Furthermore, the drain 54 of each TFT 46 may be electrically connected to a respective pixel electrode 48. Each TFT 46 serves as a switching element which may be activated and deactivated (e.g., turned on and off) for a predetermined period based upon the respective presence or absence of a scanning signal at the gate 52 of the TFT 46. For instance, when activated, the TFT 46 may store the image signals received via a respective source line 44 as a charge its corresponding pixel electrode 48. The image signals stored by pixel electrode 48 may be used to generate an electrical field between the respective pixel electrode 48 and a common electrode (not shown in FIG. 5, but represented as part of a common electrode sub-plate 64 in subsequent FIGS.). As discussed above, the pixel electrode 48 and the common electrode may form a liquid crystal capacitor for a given unit pixel 40. Thus, in an LCD panel 38, such an electrical field may align liquid crystals molecules within a liquid crystal layer to modulate light transmission through a region of the liquid crystal layer that corresponds to the unit pixel 40. For instance, light may be transmitted through the unit pixel 40 at an intensity corresponding to the applied voltage (e.g., from a corresponding source line 44).

The display 18 also includes a source driver integrated circuit (source driver IC) 56, which may include a chip, such as a processor or ASIC, that is configured to control various aspects of display 18 and panel 30. For example, the source driver IC 56 may receive image data 58 from the processor(s) 12 and send corresponding image signals to the unit pixels 40 of the panel 38. The source driver IC 56 may also be coupled to a gate driver IC 60, which may be configured to activate or deactivate rows of unit pixels 40 via the gate lines 42. As such, the source driver IC 56 may send timing information, shown here by reference number 62, to gate driver IC 60 to facilitate activation/deactivation of individual rows of pixels 40. In other embodiments, timing information may be provided to the gate driver IC 60 in some other manner. While the illustrated embodiment shows only a single source driver IC 56 coupled to panel 38 for purposes of simplicity, it should be appreciated that additional embodiments may utilize multiple source driver ICs 56 for providing image signals to the pixels 40. For example, additional embodiments may include multiple source driver ICs 56 disposed along one or more edges of the panel 38, wherein each source driver IC 56 is configured to control a subset of the source lines 44 and/or gate lines 42.

In operation, the source driver IC 56 receives image data 58 from the processor 12 or a discrete display controller and, based on the received data, outputs signals to control the pixels 40. For instance, to display image data 58, the source driver IC 56 may adjust the voltage of the pixel electrodes 48 (abbreviated in FIG. 6 as P.E.) one row at a time. To access an individual row of pixels 40, the gate driver IC 60 may send an activation signal to the TFTs 46 associated with the particular row of pixels 40 being addressed. This activation signal may render the TFTs 46 on the addressed row conductive. Accordingly, image data 58 corresponding to the addressed row may be transmitted from source driver IC 56 to each of the unit pixels 40 within the addressed row via respective source lines 44. Thereafter, the gate driver IC 60 may deactivate the TFTs 46 in the addressed row, thereby impeding the pixels 40 within that row from changing state until the next time they are addressed. The above-described process may be repeated for each row of pixels 40 in the panel 38 to reproduce image data 58 as a viewable image on the display 18.

Figure 7:
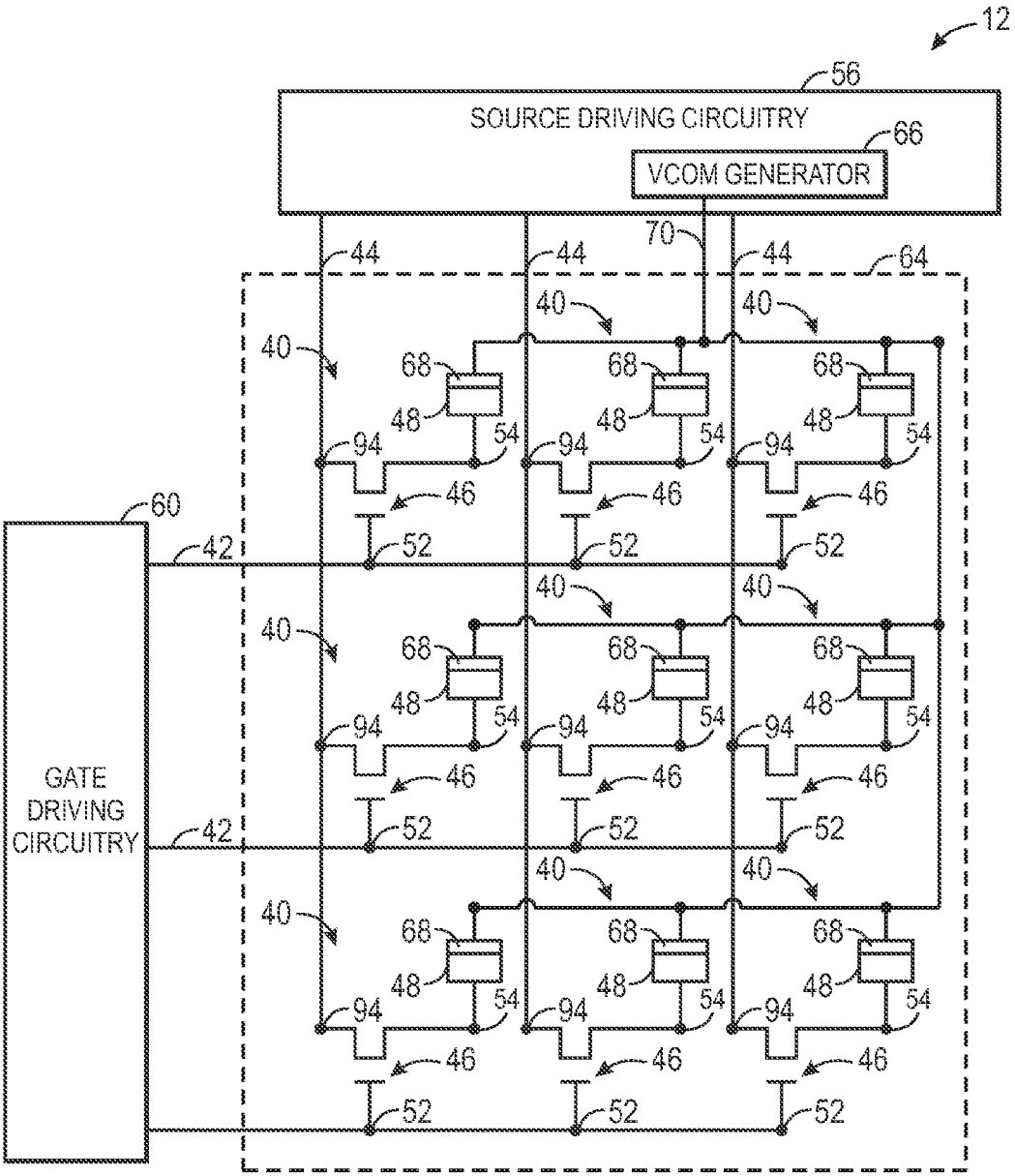
FIG. 7 is a circuit diagram illustrating the structure of a sub-plate in the display of FIG. 6, in accordance with an embodiment of the present approach.

In some embodiments, the common electrode of the panel 38 may be divided into several common electrode sub-plates 64. This effectively produces separate groups of pixels that are each associated with a different common electrode sub-plate 64. FIG. 7 depicts a common electrode sub-plate 64 associated with nine unit pixels 40, though it should be appreciated that the common electrode sub-plates 64 may be associated with any suitable number of pixels. The source driver IC 56 and the gate driver IC 60 are coupled to the unit pixels 40 by the source lines 44 and the gate lines 42, respectively, as described above. Further, the source driver IC 56 may include a $V_{COM}$ generator 66 that provides a common voltage ($V_{COM}$) via a common voltage line 70. Although FIG. 7 depicts one common electrode sub-plate 64, it should be appreciated that the panel 38 includes multiple sub-plates 64 and that the $V_{COM}$ generator 66 may be coupled to each of the common electrode sub-plates 64 by one or more common voltage lines 70.

The changing values of the source voltages and, subsequently, the electric fields within the pixels 40, may introduce cross-talk that may affect the actual value of $V_{COM}$ at different locations within the panel 38. Additionally, data differences, the noise accrued during signal transmission (which may be increased or decreased depending on the location of the pixel 40 relative to the $V_{COM}$ generator 66), and loading affects may also affect the actual value of $V_{COM}$ at different locations within the panel 38. Moreover, as noted above, the actual value of $V_{COM}$ may vary from one location to another in the panel 38. As mentioned above, the amount of light that passes through a unit pixel 40 is dependent on the alignment of the liquid crystal molecules, which is dependent on the electric field created between the pixel electrode 48 and the common electrode 68. Therefore, if the value of $V_{COM}$ deviates from an expected value, the magnitude of the electric field may be incorrect, and as such, an undesired amount of light may be emitted by the unit pixel 40.

Figure 8:
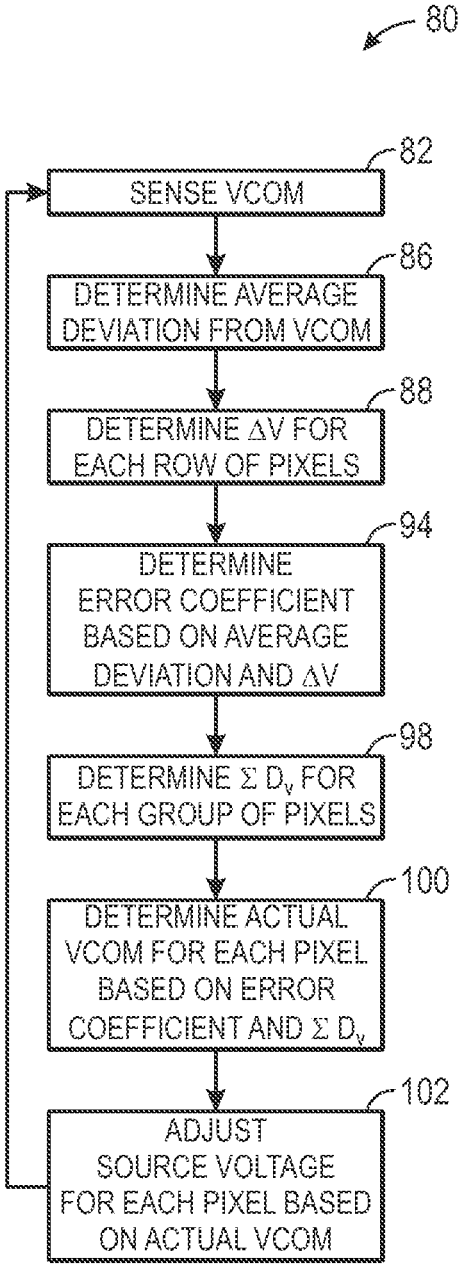
FIG. 8 is a flowchart illustrating the common voltage correction process performed by source driving circuitry in the display of FIG. 6, in accordance with an embodiment of the present approach.
Figure 9:
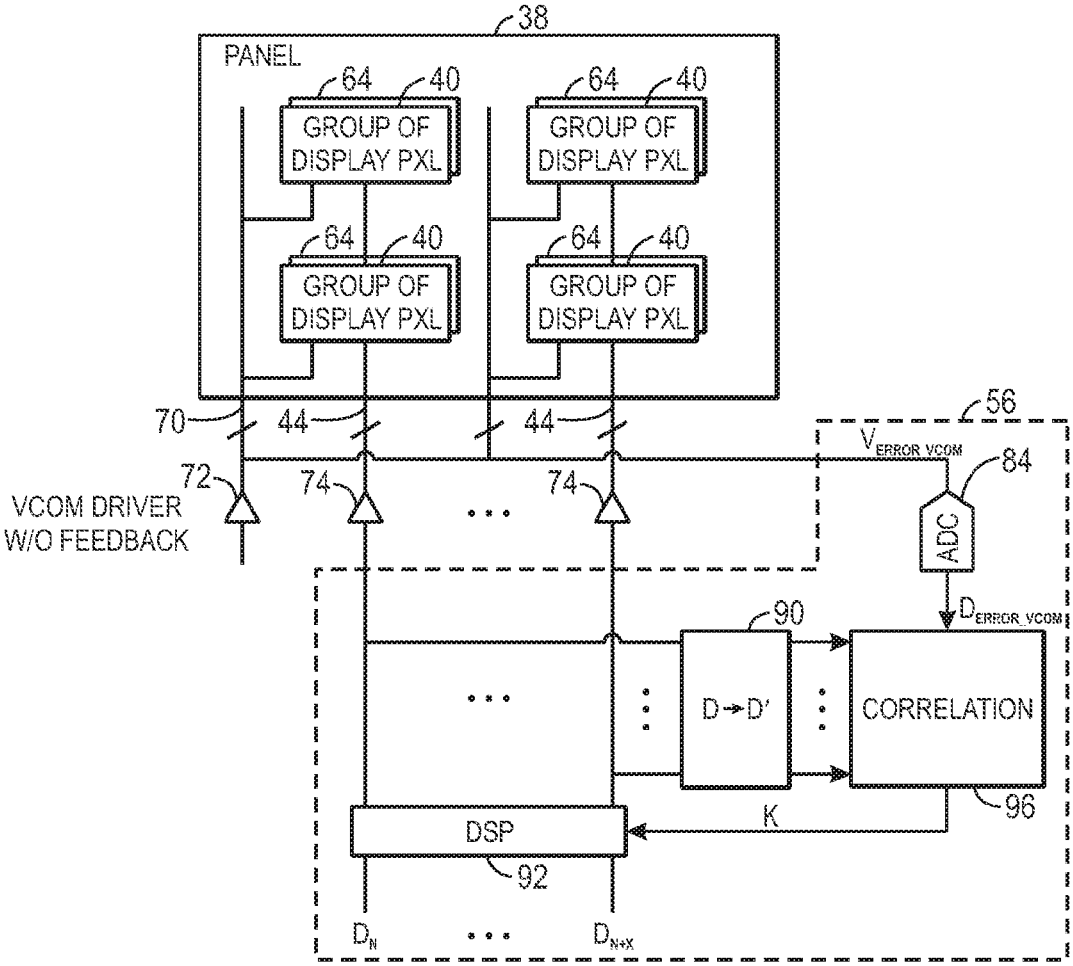
FIG. 9 is a block diagram illustrating the structure of the source driving circuitry performing the common voltage correction process of FIG. 8, in accordance with an embodiment of the present approach.

To account for the variation in the actual value of $V_{COM}$ at each pixel 40, the source driver IC 56 may perform a common voltage correction process 80 that corrects the source voltage of each pixel based on the expected value of $V_{COM}$ at the pixel. FIGS. 8 and 9, which are described concurrently in further detail below, illustrate the common voltage correction process 80 and the components of the source driver IC 56 that may perform the process 80, respectively. Although the source driver IC 56 is described as performing the common voltage correction process 80, it should be appreciated that in other embodiments, a separate system communicatively coupled to the source driver IC 56 may perform all or part of the process 80. While the common voltage correction process 80 is described below in detail, the common voltage correction process 80 may include other actions not shown in FIG. 8, and may involve other components not shown in FIG. 9. Additionally, the actions illustrated may be performed concurrently or in a different order.

Before describing the process 80 of FIG. 8, it should be noted that as illustrated in FIG. 9, a VCOM driver 72 may supply a common voltage (VCOM) on the common voltage line 70. In at least some embodiments, the VCOM driver 72 supplies the VCOM without adjustment to the common voltage output by the VCOM driver 72—that is, the VCOM driver 72 may attempt to supply a substantially constant supply of common voltage to the common electrode sub-plates 64 and may not adjust its output according to a VCOM voltage feedback scheme. Rather, as will be described in FIG. 8, data voltages on different groups of pixels 40 may be adjusted to account for variations across different common electrode sub-plates 64. This may allow a single VCOM driver 72 to supply the common voltage to all of the common electrode sub-plates 64. Additionally or alternatively, more than one VCOM driver 72 may supply the common voltage to different common electrode sub-plates 64. Moreover, in some embodiments, a common voltage feedback scheme may be employed in addition to correcting the effect of common voltage error through adjustments to the data voltages.

The causes of common voltage error on the common electrode sub-plates 64 may be manifold. When the VCOM driver 72 supplies the common voltage to the various common electrode sub-plates 64, the different common electrode sub-plates 64 may be affected by differing amounts of noise. For instance, the different common electrode sub-plates 64 may suffer from different disturbances due to different impedance mismatches, differences in the data voltages being supplied to the pixels 40 associated with the different common electrode sub-plates 64, different locations of the common voltage sub-plates in relation to other circuitry of the electronic device 10, or different loading effects. These differences in common voltage on the different common electrode sub-plates 64 may cause the voltage on the common voltage line 70 to be different from that which is attempted to be supplied by the VCOM driver 72. At block 82, the source driver IC 56 may sense the value of $V_{COM}$ output by the VCOM driver 72 and convert the voltage value to a digital value using an analog-to-digital converter (ADC) 84. This voltage may be detected at a common node that is coupled to some or all of the common electrode sub-plates 64, and is shown in FIG. 9 as $V_{ERROR_VCOM}$. This value of $V_{ERROR_VCOM}$ may be understood to be a common mode common voltage error signal that represents an average of a deviation from the desired or attempted common voltage of each common electrode sub-plate 64.

The sensed voltage $V_{ERROR_VCOM}$ may be received by the analog-to-digital converter (ADC) 84 in the source driver IC 56 and converted to a digital value $D_{ERROR_VCOM}$, as shown in FIG. 9 and block 86 of FIG. 8. Because the value $D_{ERROR_VCOM}$ is merely a digitization of $V_{ERROR_VCOM}$, the following discussion will refer to calculations involving $V_{ERROR_VCOM}$, but it should be appreciated that the digital form of $V_{ERROR_VCOM}$ (i.e., $D_{ERROR_VCOM}$) is used by the digital signal processor (DSP) 92. In the example shown in FIG. 9, the actual value of $V_{COM}$ received into the ADC 84 (that is, $V_{ERROR_VCOM}$) is likely to vary from the desired value of $V_{COM}$ attempted to be supplied by VCOM driver 72. This may be understood to be a common mode error, since it represents the average value of $V_{COM}$ seen by all of the common electrode sub-plates 64. As mentioned above, the value of $V_{COM}$ may vary from one common electrode sub-plate 64 to another and across a common electrode sub-plate 64 due to data difference, different locations in relation to the $V_{COM}$ generator 66, loading effects, local noise, and so forth. As such, the common mode common voltage error represents an averaging of the differences in $V_{COM}$ across the panel 38.

Referring back to FIG. 8, at block 88, the source driver IC 56 determines a total data voltage difference (ΔV), which represents, for a row of unit pixels 40, the difference between all of the source voltages for the unit pixels 40 from one line of image data written to the display panel 38 to the next. That is, for each row, the source driver IC 56 sums the change in the source voltage for each unit pixel 40 from the previous line (D') to the current line (D). The source driver IC 56 may include a ΔV calculator 90 that receive the values of the source voltages for each unit pixel 40 from a digital signal processor 92 within the source driver IC 56 that determines the source voltages, as depicted in FIG. 9. The ΔV calculator 90 may be an arithmetic logic unit or another processor within the source driver IC 56. In certain embodiments, the ΔV calculator 90 may include a line buffer to temporarily store the source values of each unit pixel from the previous line, or may include fewer buffers to store the total value of the pixel data supplied to each group of display pixels 40. The ΔV calculator 90 may then compare the current values of the source voltages to previous values of the source voltages, which may be stored in the line buffer mentioned above or other memory associated with or contained in the source driver IC 56. As noted above, the changing electric fields in the unit pixels 40, due to the changing values of the source voltages, may introduce cross-talk that affects the value of $V_{COM}$.

Specifically, based on simulations, it is believed that the $V_{ERROR_VCOM}$ is directly proportional to the sum of source voltages supplied to the pixels, as shown below in equation 1. A correlation component 96 within the source driver IC 56, shown in FIG. 9, may use the relationship shown in equation 1 below to determine an error coefficient (K) for each row of pixels at block 94.

$$V_{ERROR_VCOM}=K*\Delta V \tag{1}$$

At block 98, the source driver IC 56 determines respective sums of the differences in source voltages $\Sigma D_v$ for the next row of pixels of each common electrode sub-plate 64. The value $\Sigma D_v$ may be calculated by the digital signal processor 92. It is believed that the actual value of $V_{COM}$ on a given common electrode sub-plate 64 may vary depending on the total value of the difference of source voltages being applied to pixels associated with that common electrode sub-plate 64. Indeed, it is believed that the actual $V_{COM}$ on each common electrode sub-plate 64 is directly proportional to the sum of the source voltages $\Sigma D_v$ for the pixel(s) associated with that common electrode sub-plate 64. The proportionality constant in the relationship is the error coefficient (K). In other words, it may be understood that a component of the common mode voltage error attributable to each common electrode sub-plate 64 may depend on the error coefficient and the total voltage difference value $\Sigma D_v$. Thus, the actual value of $V_{COM}$ on a given common electrode sub-plate 64 may be as shown below:

$$\text{Actual } V_{COM}(\text{common electrode sub-plate})=K*\Sigma D, \tag{2}$$

Thus, using the value of K determined at block 94 and the subtotal of the differences in source voltages for the row associated with a given common electrode sub-plate 64, the digital signal processor 92 may estimate the actual value of $V_{COM}$ of that common electrode sub-plate 64.

Once the digital signal processor 92 determines the actual value of $V_{COM}$ of the common electrode sub-plate 64, the digital signal processor 92 may adjust the source voltage of the pixel such that the desired electric field is created in each pixel at block 102.

Figure 10:
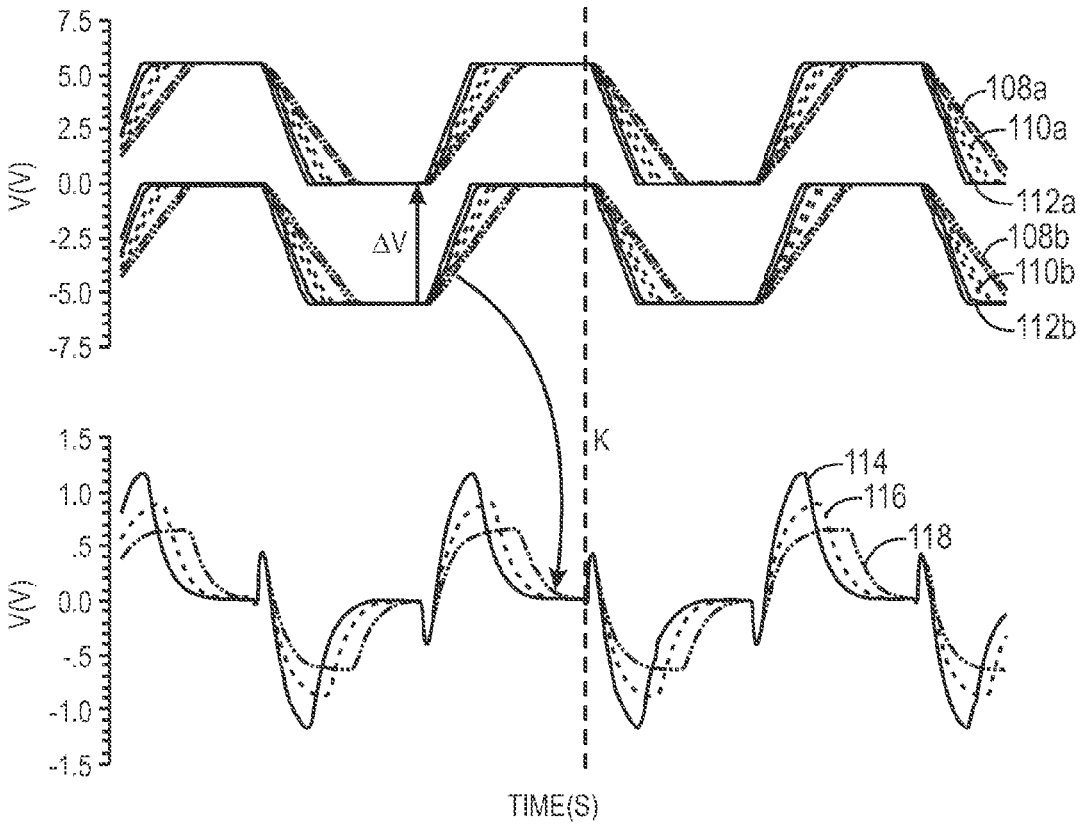
FIG. 10 is a graph illustrating the relationship between the change in the source voltages of a group of pixels and the deviation of the common voltage for the group of pixels.

FIG. 10 depicts simulation results for a display 18 that illustrate the relationship between ΔV and the common mode common voltage error. FIG. 10 includes an abscissa 104 having a time and an ordinate 106 having a voltage. FIG. 10 also includes a pixel 1 source voltage 108*a*, a pixel 2 source voltage 110*a*, and a pixel 3 source voltage 112*a*, which represent the source voltages of pixels 1, 2, and 3, respectively, during a first frame. Further, FIG. 10 includes a pixel 1 source voltage 108*b*, a pixel 2 source voltage 110*b*, and a pixel 3 source voltage 112*b*, which represent the source voltages of pixels 1, 2, and 3, respectively, during a second frame following the first frame. As shown in FIG. 10, ΔV represents the change in the value of the source voltages for a pixel from one frame to the next.

FIG. 10 also includes a pixel 1 $V_{COM}$ 114, a pixel 2 $V_{COM}$ 116, and a pixel 3 $V_{COM}$ 118. As shown in FIG. 10, the values of ΔV and $V_{COM}$ for each of the pixels are directly proportional, peaking and bottoming at roughly the same time. The exact value of the proportional constant is the error coefficient K, as described above.

Figure 11:
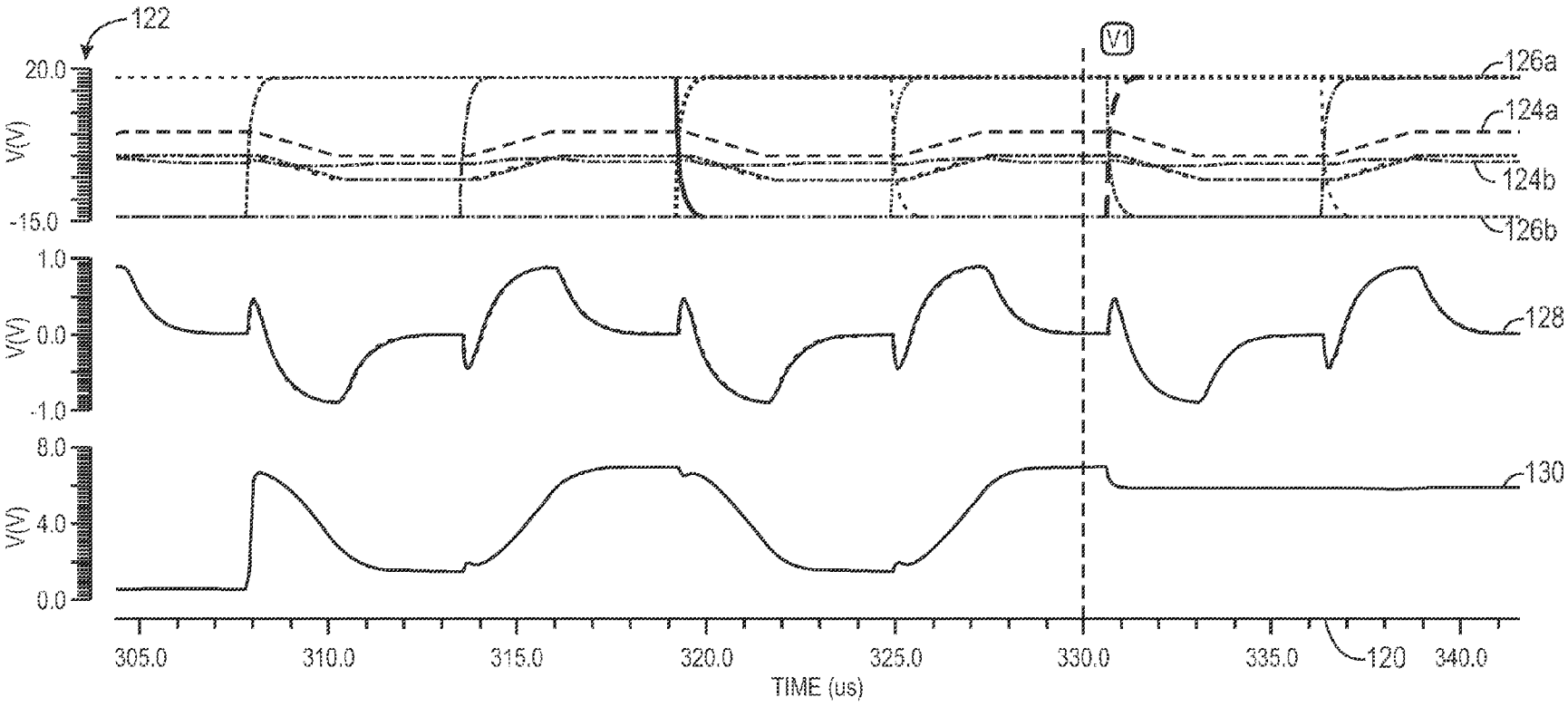
FIG. 11 is a graph illustrating the simulation of a display employing the common voltage correction process of FIG. 8, in accordance with an embodiment of the present approach.

FIG. 11 depicts a simulation of a display 18 that employs the common voltage correction process 80. FIG. 11 includes an abscissa 120 having a time and an ordinate 122 having a voltage. FIG. 11 also includes common voltages 124*a* and 124*b*, which represent the common voltage provided to a first pixel and a second pixel, respectively. Further, FIG. 11 includes source voltages 126*a* and 126*b*, which are provided to the first and second pixels, respectively. As shown in FIG. 11, the simulated pixels are configured such that source voltages of opposite polarity may cause the pixels to emit the same amount of light. FIG. 11 further includes average deviation 128 of the value of $V_{COM}$ for the pixels. Finally, FIG. 11 includes a display voltage 130 which represents the difference between the adjusted source voltage and the common voltage. As shown in FIG. 11, the display voltage 130 quickly settles and maintains a stable magnitude despite the fluctuations in the average deviation 128. In one particular example, the common voltage on a particular common electrode sub-plate 64 may be determined to be approximately 5.98 mV higher than desired and the unadjusted source voltage may be 5.5 V. The image data may be adjusted by adding 5.98 mV to the 5.5 V source voltage to produce adjusted image data of 5.5098, thereby negating the effect of the common voltage error on the common electrode sub-plate 64. By adjusting the display content in this way, voltage errors due to incomplete settling can be corrected.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic display comprising:

a first common electrode sub-plate associated with a first group of pixels;

a second common electrode sub-plate associated with a second group of pixels, wherein the second common electrode sub-plate is at least partially separate from the first common electrode sub-plate; and driver circuitry configured to:

provide a target common voltage to a common voltage line to the first common electrode sub-plate and the second common electrode sub-plate;

sense a common mode common voltage on the common voltage line, wherein the common mode common voltage differs from the target common voltage based at least partly on electrical characteristics of the first common electrode sub-plate and the second common electrode sub-plate;

receive first image data signals for a first row of the first group of pixels and the second group of pixels;

adjust the first image data signals based at least in part on the common mode common voltage and a total data voltage difference between a sum of all of the first image data signals and a sum of second image data signals previously programmed into a second row of the first group of pixels and the second group of pixels; and program the adjusted first image data signals into the first row of pixels of the first group of pixels and the second group of pixels.

2. The electronic display of claim 1, wherein the driver circuitry is configured to determine an actual first common voltage on the first common electrode sub-plate and determine an actual second common voltage on the second common electrode sub-plate based at least in part on the common mode common voltage, and wherein the first image data signals are adjusted the first image data signals based at least in part on the actual first common voltage and the actual second common voltage.

3. The electronic display of claim 1, wherein the second row of the first group of pixels and the second group of pixels is immediately adjacent to the first row of the first group of pixels and the second group of pixels.

4. The electronic display of claim 1, wherein the driver circuitry is configured to determine an error coefficient based on the common mode common voltage and the total data voltage difference, wherein the first image data signals are adjusted based at least in part on the error coefficient.

5. The electronic display of claim 4, wherein the driver circuitry is configured to determine the error coefficient as a proportional constant relating the total data voltage difference to the common mode common voltage.

6. The electronic display of claim 4, wherein the driver circuitry is configured to determine the error coefficient according to the following relationship:

$$V_{ERROR_VCOM}=K*\Delta V,$$

where $V_{ERROR_VCOM}$ represents the common mode common voltage, $\Delta V$ represents the total data voltage difference, and K represents the error coefficient.

7. The electronic display of claim 4, wherein the driver circuitry is configured to determine an actual first common voltage on the first common electrode sub-plate based on the error coefficient and a sum of a difference between a first portion of the first image data signals that correspond to pixels associated with the first common electrode sub-plate and a corresponding first portion of the second image data signals, wherein the current first portion of the first image data signals is adjusted based at least in part on the actual first common voltage.

8. The electronic display of claim 7, wherein the driver circuitry is configured to determine the actual first common voltage on the first common electrode sub-plate according to the following relationship:

$$\text{Actual } V_{COM}(\text{common electrode sub-plate})=K*\Sigma D_v$$

where Actual $V_{COM}$ (common electrode sub-plate) represents the actual first common voltage on the first common electrode sub-plate, $\Sigma D_v$ represents the sum of the difference between a first portion of the first image data signals that correspond to pixels associated with the first common electrode sub-plate and a corresponding first portion of the second image data signals, and K represents the error coefficient.

9. A method comprising:

supplying a target common voltage to a common voltage line coupled to a first common electrode sub-plate of an electronic display and a second common electrode sub-plate of the display, wherein the second common electrode sub-plate is at least partially separate from the first common electrode sub-plate;

sensing a common mode common voltage error on the common voltage line with regard to the target common voltage as first image data signals are being supplied to a first row of pixels, wherein a first group of pixels of the first row of pixels pertains to the first common electrode sub-plate and a second group of pixels of the first row of pixels pertains to the second common electrode sub-plate;

determining a total data voltage difference between a sum of all of the first image data signals and a sum of second image data signals previously programmed into a second row adjacent to the first row of pixels; and adjusting the first image data signals based at least in part on the total data voltage difference and the common mode common voltage error.

10. The method of claim 9, wherein supplying the target common voltage to the common voltage line comprises providing a static voltage that is not increased or decreased based on feedback.

11. The method of claim 9, comprising:

determining an error coefficient that relates the total data voltage difference to the common mode common voltage; and using the error coefficient to determine an actual first common voltage on the first common electrode sub-plate and an actual second common voltage on the second common electrode sub-plate;

wherein the first image data signals are adjusted to account for the actual first common voltage and the actual second common voltage.

12. The method of claim 11, comprising determining a first portion of the total data voltage difference corresponding to pixels associated with the first common electrode sub-plate, wherein using the error coefficient to determine the actual first common voltage comprises multiplying the first portion by the error coefficient.

13. An electronic device comprising:

a processor configured to determine image data; and an electronic display configured to display the image data after adjusting the image data based on a total data voltage difference and a common mode common voltage error on a common voltage line coupled to a plurality of different common electrode sub-plates, each common electrode sub-plate carrying a common voltage that varies depending on the common mode common voltage error and values of the image data programmed to pixels associated with that common electrode sub-plate;

wherein the total data voltage difference comprises a difference between a sum of first image data signals at a first time and a sum of second image data signals at a second time prior to the first time;

wherein the common mode common voltage error comprises a difference between a target voltage and a detected voltage on the common voltage line.

14. The electronic device of claim 13, wherein the electronic display is configured to display the image data after adjusting the image data without varying a target voltage attempted to be supplied to the common voltage line coupled to the different common electrode sub-plates.

15. The electronic device of claim 13, wherein the electronic display is configured to display the image data after adjusting the image data without providing any feedback to a common voltage supply that attempts to supply a target voltage to the common voltage line coupled to the different common electrode sub-plates.

16. The electronic device of claim 13, wherein the electronic device comprises a handheld device, a wearable device, a notebook computer, a desktop computer, a media player, a telephone, a tablet computer, or any combination thereof.

17. Driving circuitry for an electronic display comprising:

an analog-to-digital converter configured to digitize a common mode common voltage error sensed on a common voltage line coupled to a plurality of different common electrode sub-plates of an electronic display;

voltage difference calculation circuitry configured to calculate a total data voltage difference between a sum of first image data signals to be programmed onto a first row of pixels and a sum of second image data signals previously programmed into a second row of pixels adjacent to the first row of pixels;

correlation circuitry configured to determine an error coefficient that relates the total data voltage difference to the common mode common voltage error; and image data adjustment circuitry configured to adjust the first image data signals based on the error coefficient;

wherein the common mode common voltage error comprises a difference between a target voltage and a detected voltage on the common voltage line.

18. The driving circuitry of claim 17, wherein the correlation circuitry is configured to determine the error coefficient according to the following relationship:

$$V_{ERROR_VCOM}=K*\Delta V,$$

where $V_{ERROR_VCOM}$ represents the common mode common voltage error, $\Delta V$ represents the total data voltage difference, and K represents the error coefficient.

19. The driving circuitry of claim 17, comprising a common voltage supply that attempts to supply the target voltage to the common voltage line without varying the target voltage based on feedback.

* * * * *